US007138020B2

(12) United States Patent
Groh et al.

(10) Patent No.: US 7,138,020 B2
(45) Date of Patent: Nov. 21, 2006

(54) METHOD FOR REDUCING HEAT TREATMENT RESIDUAL STRESSES IN SUPER-SOLVUS SOLUTIONED NICKEL-BASE SUPERALLOY ARTICLES

(75) Inventors: Jon Raymond Groh, Loveland, OH (US); Shesh Krishna Srivatsa, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 54 days.

(21) Appl. No.: 10/685,640

(22) Filed: Oct. 15, 2003

(65) Prior Publication Data

US 2005/0081968 A1 Apr. 21, 2005

(51) Int. Cl.
*C12D 11/00* (2006.01)
*C22F 1/10* (2006.01)

(52) U.S. Cl. ..... 148/511; 148/675

(58) Field of Classification Search ..... None
See application file for complete search history.

(56) References Cited

U.S. PATENT DOCUMENTS

| | | | | |
|---|---|---|---|---|
| 4,685,977 A | | 8/1987 | Chang | 148/12.7 N |
| 4,820,356 A | | 4/1989 | Blackburn et al. | 148/675 |
| H0647 H | * | 7/1989 | Johnson et al. | 29/417 |
| 5,302,217 A | | 4/1994 | Gostic et al. | 148/675 |
| 5,419,792 A | | 5/1995 | King et al. | 148/637 |
| 5,593,519 A | | 1/1997 | Blankenship, Jr. et al. | 148/514 |
| 5,891,272 A | | 4/1999 | Raymond et al. | 148/410 |
| 5,935,353 A | | 8/1999 | Murphy et al. | 148/675 |
| 6,532,657 B1 | | 3/2003 | Weimer et al. | 29/889.2 |

FOREIGN PATENT DOCUMENTS

| | | | |
|---|---|---|---|
| DE | 1936007 A | | 1/1970 |
| EP | 0260512 A2 | | 3/1988 |
| EP | 0260512 A2 | * | 3/1988 |
| EP | 1201777 A1 | * | 5/2002 |

* cited by examiner

*Primary Examiner*—Roy King
*Assistant Examiner*—Michael P. Alexander
(74) *Attorney, Agent, or Firm*—Harrington & Smith, LLP

(57) ABSTRACT

In accordance with an embodiment of the present invention, a method for reducing residual stress in a nickel-base superalloy article comprising about 40–70% of gamma prime phase and having a gamma prime solvus temperature is disclosed. The method comprises the steps of super-solvus heat treating the superalloy article about 5–40° F. (3–22° C.) above the gamma prime solvus temperature; and holding at the super-solvus heat treatment temperature for about 0.25–2 hours, wherein the heat-treated superalloy article has reduced residual stress.

16 Claims, No Drawings

METHOD FOR REDUCING HEAT TREATMENT RESIDUAL STRESSES IN SUPER-SOLVUS SOLUTIONED NICKEL-BASE SUPERALLOY ARTICLES

FIELD OF THE INVENTION

The invention relates to heat treatments for nickel-base superalloy articles to reduce residual stress.

BACKGROUND OF THE INVENTION

Higher operating temperatures for gas turbine engines are continually sought in order to increase efficiency. However, as operating temperatures increase, the high temperature durability of the components within the engine must correspondingly increase. Thus, the material capability to withstand higher temperatures must also increase.

Components formed from powder metal gamma prime (γ') precipitation strengthened nickel-base superalloys can provide a good balance of creep, tensile and fatigue crack growth properties to meet performance requirements. Typically, a powder metal component is produced by consolidating metal powders in some means, such as extrusion consolidation, then isothermally forging the consolidated material to the desired outline, and finally heat treating the forging prior to machining to the final geometry. The processing steps of consolidation and forging are designed to retain a fine grain size within the material to promote superplasticity, so as to minimize die loading and improve shape definition. In order to improve the fatigue crack growth resistance and mechanical properties of these materials at elevated temperatures, these alloys are then heat treated significantly above their gamma prime solvus temperature, to cause uniform coarsening of the grains. For example, rotors, disks, shafts and disk-like seals for aircraft engine gas turbine applications are often manufactured from gamma prime precipitation strengthened nickel-base superalloy forgings. To improve temperature capability and component reliability, the forgings are solution heat treated at temperatures significantly above the gamma prime solvus temperature to yield an average grain size of about 90 μm to 16 μm (ASTM 4–9 (Reference throughout to ASTM grain sizes is in accordance with the standard scale established by the American Society for Testing and Materials)) often followed by precipitation heat treatment, including subsolvus stress relief and/or subsolvus aging heat treat. Cooling or quenching from the above solution heat treatment process introduces residual stresses in the component. Although a minor amount of the as-quenched stress may be relieved during the precipitation heat treat exposure, often in the 1400–1550° F. (760–815° C.) range, residual stress in the resultant heat treated forgings affects component manufacturing cost and may degrade component reliability during engine operation.

BRIEF DESCRIPTION OF THE INVENTION

Applicants have determined that the extra thermal energy associated with, for instance, quench from well above the γ' solvus temperature during heat treatment results in excessive residual stress with negligible additional grain coarsening.

For example, some damage tolerant nickel-base superalloys may be heat treated significantly above the solvus temperature for grain coarsening, such as nominally gamma prime solvus temperature plus about 65–75° F. (36–42° C.) and furnace tolerances of about $^{+}/-25°$ F. ($^{+}/-14°$ C.). This may yield an increased production metal temperature range of about 40–100° F. (22–56° C.) above the gamma prime solvus. Applicants have determined that not only is this excess heat not required for acceptable grain coarsening, but that it also contributes to unwanted, excessive residual stress in the superalloy material.

Accordingly, there exists a need for improved heat treatment processes for reducing residual stress in nickel-base superalloys. The present invention addresses this need.

In accordance with an embodiment of the invention, a method for reducing residual stress in a nickel-base superalloy article comprising about 40–70% of gamma prime phase and having a gamma prime solvus temperature is disclosed. The method comprises the steps of super-solvus heat treating the superalloy article only about 5–40° F. (3–22° C.) above the gamma prime solvus temperature, and holding at the super-solvus heat treatment temperature for a time sufficient to equilibrate the temperature throughout the cross-section, typically about 0.25–2 hours. Advantageously, the heat treated superalloy article exhibits reduced residual stress.

In accordance with a further embodiment of the invention, a method for reducing residual stress of a nickel-base superalloy article comprising about 40–70% of gamma prime phase and having a gamma prime solvus temperature is disclosed. The method comprises the steps of providing a furnace having a furnace tolerance temperature, and super-solvus heat treating the superalloy article to about the gamma prime solvus temperature plus the furnace tolerance temperature. The method further comprises holding at the super-solvus heat treatment temperature for about 0.25–2 hours, wherein the heat treated superalloy article has reduced residual stress.

An advantage of embodiments of the invention includes a super-solvus heat treatment above the gamma prime solvus temperature with as little superheat as possible for a production environment. Less thermal energy, lower thermal gradient, and slightly finer grain structure combine to minimize residual stress in the heat treated forging. Moreover, final part manufacture may be achieved with less machining distortions and dimensional stability is improved during engine operation. Also, since quenching may introduce residual stresses that vary depending upon factors such as interaction of cooling rate, quench method, part size and geometry, thermal gradients and material behavior, coincident reduction in stresses during quench from solution as a result of embodiments of the invention provide an further benefit with respect to quench crack risk reduction.

Additionally, processes of the present invention achieve a desirable balance of coarse grain size for appropriate gamma prime grain growth, as well as a reduction in residual stress by eliminating excess thermal energy. Accordingly, improved component reliability and cost savings are achieved.

Other features and advantages will be apparent from the following more detailed description.

DETAILED DESCRIPTION OF THE INVENTION

The heat treatment processes of the present invention are principally directed for use with nickel-base superalloys that exhibit a mixture of both gamma and gamma prime phases, and in particular those superalloys that have at least about 40 percent or more by volume of the gamma phase at ambient temperatures. For example, the heat treatment processes are particularly suited for heat treating a nickel-base superalloy article comprising about 40–70% of gamma prime phase and having a gamma prime solvus temperature of about 1800–2160° F. (982–1182° C.).

Table 1 illustrates a representative, non-limiting group of nickel-base superalloys for which embodiments of the invention may be used and their compositions in weight percent.

TABLE 1

| Element | Rene'88DT | Rene95 | IN100 | U720 | Waspaloy | Astroloy |
|---|---|---|---|---|---|---|
| Co | 13 | 8 | 15 | 14.7 | 13.5 | 17 |
| Cr | 16 | 14 | 10 | 16 | 19.5 | 15 |
| Mo | 4 | 3.5 | 3 | 3 | 4.3 | 5.25 |
| W | 4 | 3.5 | 0 | 1.25 | 0 | 0 |
| Al | 2.0 | 3.5 | 5.5 | 2.5 | 1.4 | 4.4 |
| Ti | 3.6 | 2.5 | 4.7 | 5 | 3 | 3.5 |
| Ta | 0 | 0 | 0 | 0 | 0 | 0 |
| Nb | 0.7 | 3.5 | 0 | 0 | 0 | 0 |
| Fe | 0 | 0 | 0 | 0 | 0 | 0.35 |
| Hf | 0 | 0 | 0 | 0 | 0 | 0 |
| Y | 0 | 0 | 0 | 0 | 0 | 0 |
| Zr | 0.05 | 0.05 | 0.06 | 0.03 | 0.07 | 0 |
| C | 0.05 | 0.01 | 0.014 | 0.01 | 0.006 | 0.03 |
| V | 0 | 0 | 1.0 | 0 | 0 | 0 |
| B | 0.015 | 0.01 | 0.014 | 0.03 | 0.006 | 0.03 |

The foregoing alloys characteristically have substantially gamma grains with gamma prime distributed within the grains and along the grain boundaries, with the distribution of the gamma prime phase depending largely on the thermal and mechanical processing of the alloy.

Embodiments of the present invention will often be applied to forgings of the afore-referenced superalloys. The forged articles may be produced by methods conventionally known in the art. For example, a forging pre-form of desired size and shape that serves as a suitable pre-form, so long as it possesses the characteristics that are compatible with being formed into a suitable forged article, may be employed. The pre-form may be formed by any number of well-known techniques. In one process, the forming of the forged pre-form is accomplished by hot-extruding a nickel-base superalloy powder, such as by extruding the powder at a temperature sufficient to consolidate the particular alloy powder into a billet, blank die extruding the billet into the desired shape and size, and then hot die or isothermal upset forge to the forging configuration prior to super-solvus solution heat treatment. These operations are typically performed well below the gamma prime solvus to retain a fine grain structure beneficial to malleability. Forgings often have a grain size on the order of about 10 μm or finer.

As indicated above, embodiments of the present invention do not require the forming of an alloy pre-form or forging the pre-form. It is sufficient to, for example, merely select a nickel-base superalloy pre-form having the characteristics described above. The selection of the forging perform shapes and sizes in order to provide a shape that is suitable for forging into an article ready for finishing operations may be performed by methods conventionally known in the art.

Similarly, embodiments of the invention also do not require forming the forged article. It is sufficient to merely select a forged nickel-base superalloy article as forging a nickel-base superalloy article is conventionally known in the art, or employ other suitable nickel-base superalloys as the starting material.

The starting nickel-base superalloy article may then be subjected to the proposed heat treatment processes, which have been found to reduce residual stress in the article. In particular, we have found that a balance of desirable properties, particularly a significant reduction in residual stress, may be achieved by heating the superalloy article to above the gamma prime solvus temperature, but as close to the gamma prime solvus temperature as possible. For example, embodiments of the invention comprise a first step of super-solvus heat treating the superalloy article only about 5–40° F. (3–22° C.) or about 15–40° F. (8–22° C.) or even about 25–30° F. (14–17° C.) above the gamma prime solvus temperature of the superalloy article, and holding at this temperature for between about 0.25–2 hours, typically about 1 hour or about 1–2 hours, to reach equilibrium at temperature.

The gamma prime solvus temperature will vary depending upon the composition of the superalloy. For example, the gamma prime solvus temperature of René 88DT has been reported to be about 2030–2040° F. (1110–1116° C.). One skilled in the art will recognize that the gamma prime solvus temperature is a function of actual composition.

In further embodiments, the superalloy article is advantageously heated to only about 15° F. (8 C°) or about 25° F. (14° C.) above the gamma prime solvus temperatures in the afore-described first step. When the gamma prime solvus temperature is exceeded, the gamma prime dissolves; thereby grain growth cannot be retarded by gamma prime. This leads to grain growth and results in the desired coarse grain structure, which improve creep and fatigue crack growth resistance with a coincident reduction in nominal tensile strength and fatigue initiation life.

We have found that by heating the superalloy article to a temperature just above the gamma prime solvus temperature with as little superheat as possible, a significant reduction in residual stress may be achieved without compromising the grain structure. For example, production furnaces often have a tolerance of about $^{+}/-25°$ F. ($^{+}/-14°$ C.). Targeting nominal super-solvus solution at gamma prime solvus plus 65–75° F. (36–42° C.) may yield a production metal temperature range of about $^{+}40$ to $^{+}100°$ F. ($^{+}22$–$^{+}56°$ C.) above the gamma prime solvus. We have determined that this extra thermal energy results in excessive residual stress and thermal gradients during quench. However, according to embodiments of the invention, we have further determined that if the superalloy article is heated to only about the gamma prime solvus temperature plus the furnace tolerance temperature, excessive residual stress may be avoided without adversely affecting grain structure. The allowed furnace tolerance temperature may vary, but may include temperatures from about +/−5° F. (3° C.) to +/−40° F. (22° C.) to name a few. For example, solution heat treat tolerance specified by AMS5707 for Waspaloy, is +/−25° F. (+/−14° C.). The furnace tolerance temperature may be analyzed by placing thermocouples embedded within representative metal at various locations of a furnace and taking temperature readings from the thermocouples. The temperature range within which the thermocouple temperature readings need to be represents the furnace tolerance temperature. According to further embodiments of the invention, an additional 5° F. (3° C.) also may be added to the furnace tolerance temperature as an additional safety feature.

After super-solvus heating, followed by hold at the super-solvus temperature, the superalloy article then may be quenched, followed by subsolvus precipitation heat treatment. For example, the superalloy article may be cooled by conventional methods to ambient temperature. Suitable methods may include still air cooling, water or oil quenching, forced air cooling, and combinations thereof. Cooling methods are selected to balance mechanical properties, microstructural features, and the risk of quench cracks. A useful controlled cooling method is also described in U.S. Pat. No. 5,419,792 of common Assignee. According to this patent, in part, a cooling fluid is controlled to follow the work-piece surface according to pre-selected cooling fluid convective cooling parameters including, but not limited to, cooling fluid direction, mass flow rate, and velocity at the selected locations. All patents and publications referenced herein are incorporated by reference.

If desired, the quenched superalloy article may be precipitation heat treated by, for example, conventional subsolvus aging methods or subjected to stress relief methods also known to those of ordinary skill. These processes include, for example, 1550° F.+/−15° F. (843° C.+/−8° C.) stabilization for 4 hours +/−0.5 hours and 1400° F.+/−15° F. (760° C.+/−8° C.) for 16 hours +/−1 hour, as specified in AMS5707. Further processes include stress relief at about 1550° F. (843° C.) for about 4 hours followed by aging at about 1400° F. (760° C.) for about 8 hours, which is particularly suitable for alloys such as René 104 (nominal composition in weight percent of 20.6Co, 13Cr, 3.4Al, 3.7Ti, 2.1W, 2.4Ta, 0.9Nb, 3.8Mo, bal. Ni and minor elements). Similarly, Alloy René 88DT referenced in the below examples, may be aged at about 1400° F. (760° C.) for about 8 hours without the foregoing stress relief.

Set forth below are examples of the present invention, which are meant to be merely illustrative and therefore not limiting.

EXAMPLES

Analytical testing was performed, which confirmed that the heat treatment relative to solvus temperature affects residual stress. In particular, two René 88DT test examples are set forth below. The gamma prime solvus temperature for this superalloy is typically reported to be in the range of about 2030–2040° F. (1110–1116° C.).

| Residual Stress | Quenched from | | | 2140:2100 Max Stress | 2070:2100 Max Stress | 2140:2100 Range | 2070:2100 Range |
|---|---|---|---|---|---|---|---|
| Components (ksi) | 2140° F. | 2100° F. | 2070° F. | Ratio | Ratio | Ratio | Ratio |
| Radial Min | −98 | −75 | −52 | | | | |
| Radial Max | 74 | 66 | 61 | 1.12 | 0.92 | | |
| Radial Stress Range | 172 | 141 | 113 | | | 1.22 | 0.80 |
| Axial Min | −126 | −97 | −76 | | | | |
| Axial Max | 78 | 70 | 65 | 1.11 | 0.93 | | |
| Axial Stress Range | 204 | 167 | 141 | | | 1.22 | 0.84 |
| Hoop Min | −101 | −82 | −65 | | | | |
| Hoop Max | 94 | 85 | 76 | 1.11 | 0.89 | | |
| Hoop Stress Range | 195 | 167 | 141 | | | 1.17 | 0.84 |

Stresses are after quench to ambient temperature from heat treat temperature (prior to age or stress relief)

Negative values indicate compression, positive values tension

Min and Max indicate the minimum and maximum stress values in the component, Range is the difference between Min and Max stress Reductions in Maximum and Stress range are desired for part stability during manufacture and application Using 2100° F. (1149° C.) as the baseline, the max stress components are about 11–12% higher when quenched from 2140° F. (1171° C.)

Using 2100° F. (1149° C.) as the baseline, the max stress components are advantageously about 7–11% lower when quenched from the lower temperature of 2070° F. (1132° F.)

Seal Example

Effect of R88DT Heat Treat Temperature

| Residual Stress | Quenched from | | | 2140:2100 | 2070:2100 | 2140:2100 Range | 2070:2100 Range |
|---|---|---|---|---|---|---|---|
| Components (ksi) | 2140° F. | 2100° F. | 2070° F. | Ratio | Ratio | Ratio | Ratio |
| Radial Min | −36 | −23 | −17 | | | | |
| Radial Max | 95 | 81 | 68 | 1.17 | 0.84 | | |
| Radial Stress Range | 131 | 104 | 85 | | | 1.26 | 0.82 |
| Axial Min | −74 | −51 | −27 | | | | |
| Axial Max | 21 | 17 | 15 | 1.24 | 0.88 | | |
| Axial Stress Range | 95 | 68 | 42 | | | 1.40 | 0.62 |
| Hoop Min | −63 | −42 | −31 | | | | |
| Hoop Max | 99 | 84 | 71 | 1.18 | 0.85 | | |
| Hoop Stress Range | 162 | 126 | 102 | | | 1.29 | 0.81 |

Stresses are after quench to ambient temperature from heat treat temperature (prior to age or stress relief)

Negative values indicate compression, positive values tension

Min and Max indicate the minimum and maximum stress values in the component, Range is the difference between Min and Max stress Reductions in Maximum and Stress range are desired for part stability during manufacture and application Using 2100° F. (1149° C.) as the baseline, the max stress components are about 17–24% higher when quenched from 2140° F. (1171° C.)

Using 2100° F. (1149° C.) as the baseline, the max stress components are advantageously about 12–15% lower when quenched from the lower temperature of 2070° F. (1132° F.)

The foregoing examples advantageously demonstrate the significant reduction in residual stress when the component is quenched from Applicants' lower super-solvus temperature of about 2070° F. (1132° F.), as opposed to higher super-solvus temperatures of about 2140° F. (1171° C.) and 2100° F. (1149° C.). Further improved reductions in residual stress may be achieved at a super-solvus temperature of about 2060° F.–2070° F. (1127° C.–1132° C.), including 2065° F. (1129° C.).

Advantageously, the residual stress reductions achieved by lowering the heat treat temperature also results in the following quality and cost benefits:

distortions during machining from the heat treat shape to the final shape are significantly reduced, thus saving machining costs;

excess machining stock previously required to allow for distortions can be eliminated, resulting in a less expensive forging;

dimensional stabililty of the component during service is improved, extending the useful life;

improving the ability to predict component behavior during service; and for a given furnace temperature tolerance, heat treating at a lower temperature results in less variability in residual stresses and its effects on subsequent manufacturing operations.

Additionally, the resultant average grain size of the heat treated superalloy may be between about 32 μm to about 16 μm (ASTM 7–9). Thus, the processes of the present invention achieve a desirable balance of coarse grain size for appropriate gamma prime grain growth, as well as a reduction in residual stress by eliminating excess thermal energy. Accordingly, improved component reliability and cost savings is achieved.

While various embodiments are described herein, it will be appreciated from the specification that various combinations of elements, variations or improvements therein may be made by those skilled in the art, and are within the scope of the invention.

What is claimed is:

1. A method for determining a heat treatment temperature with minimal superheat and reducing residual stress of a nickel-base superalloy article comprising about 40–70% of gamma prime phase and having a gamma prime solvus temperature, comprising the steps of:

a) providing a furnace;

b) determining a specific furnace tolerance temperature for the nickel-base superalloy by placing thermocouples embedded within representative metal on different locations of the furnace and taking temperature readings from the thermocouples;

c) super-solvus heat treating the superalloy article to only about the gamma prime solvus temperature plus only the furnace tolerance temperature of the superalloy; and d) holding at the super-solvus heat treatment temperature of c) 0 for about 0.25–2 hours, wherein the heat treated superalloy article has reduced residual stress.

2. The method of claim 1, wherein the super-solvus temperature of c) is about the gamma prime solvus temperature plus the furnace tolerance temperature plus about 5° F.

3. The method of claim 1, wherein the superalloy article is a seal or a high pressure turbine disk made of René 88DT and the super-solvus heat treatment temperature is calculated to be about 2060–2070° F.

4. The method of claim 1, wherein the superalloy article is a seal or a high pressure turbine disk.

5. The method of claim 1, wherein step d) comprises a hold of about 1–2 hours.

6. The method of claim 1, further comprising quenching the superalloy article.

7. The method of claim 1, further comprising quenching the superalloy article, followed by subsolvus precipitation heat treatment.

8. The method of claim 7, wherein the super-solvus heat treatment is calculated to be about 15–40° F. above the gamma prime solvus temperature.

9. The method of claim 8, wherein the super-solvus heat treatment is calculated to be about 25–30° F. above the gamma prime solvus temperature.

10. The method of claim 9, wherein the super-solvus heat treatment is calculated to be about 25° F. above the gamma prime solvus temperature.

11. The method of claim 8, wherein the super-solvus heat treatment is calculated to be about 15° F. above the gamma prime solvus temperature.

12. The method of claim 7, wherein the super-solvus heat treatment is calculated to be about 5° F. to about 40° F. above the gamma prime solvus temperature.

13. The method of claim 3, wherein the super-solvus heat treatment temperature is about 2065° F.

14. The method of claim 3, wherein the super-solvus heat treatment temperature is about 2070° F.

15. The method of claim 5, comprising a hold of about 1 hour.

16. A method for determining a heat treatment temperature with minimal superheat and reducing residual stress of a nickel-base superalloy article comprising about 40–70% of gamma prime phase and having a gamma prime solvus temperature, consisting essentially of the steps of:

a) providing a furnace;

b) determining a specific furnace tolerance temperature for the nickel-base superalloy by placing thermocouples embedded within representative metal on different locations of the furnace and taking temperature readings from the thermocouples;

c) super-solvus heat treating the superalloy article to only about the gamma prime solvus temperature plus only the furnace tolerance temperature; and d) holding at the super-solvus heat treatment temperature of c) for about 0.25–2 hours, wherein the heat treated superalloy article has reduced residual stress, and e) quenching the superalloy article, followed by subsolvus precipitation heat treatment, wherein the superalloy article is a seal or a high pressure turbine disk made of René 88DT and the super-solvus heat treatment temperature is calculated to be about 2060–2070° F.

* * * * *

UNITED STATES PATENT AND TRADEMARK OFFICE

CERTIFICATE OF CORRECTION

PATENT NO. : 7,138,020 B2
APPLICATION NO. : 10/685640
DATED : November 21, 2006
INVENTOR(S) : Groh et al.

It is certified that error appears in the above-identified patent and that said Letters Patent is hereby corrected as shown below:

IN THE CLAIMS:

In Claim 1: Column 8, line 48, after "c)" delete "0".

Signed and Sealed this

Sixth Day of March, 2007

JON W. DUDAS
*Director of the United States Patent and Trademark Office*